US005246047A

United States Patent [19]

Larsen

[11] Patent Number: 5,246,047

[45] Date of Patent: Sep. 21, 1993

[54] NOZZLE FOR DISPENSING PRODUCTS

[75] Inventor: Hans K. Larsen, Aestorp, Sweden

[73] Assignee: Nestec S.A., Vevey, Switzerland

[21] Appl. No.: 703,002

[22] Filed: May 20, 1991

[30] Foreign Application Priority Data

Jun. 29, 1990 [EP] European Pat. Off. ..... 90112409.9

[51] Int. Cl.[5] ..... B65B 3/04

[52] U.S. Cl. ..... 141/174; 141/147; 141/263; 141/266; 141/283; 141/284

[58] Field of Search ..... 141/186, 263, 264, 266, 141/269, 270, 280, 283, 284, 135, 137, 177, 147, 174

[56] References Cited

U.S. PATENT DOCUMENTS

| | | | |
|---|---|---|---|
| 1,104,491 | 7/1914 | Greenawalt | 141/280 X |
| 1,723,609 | 8/1929 | Edison | 141/280 X |
| 3,107,702 | 10/1963 | Gex et al. | 141/280 X |
| 3,205,920 | 9/1965 | Cozzoli et al. | 141/137 X |
| 4,269,333 | 5/1981 | Nakai et al. | 251/9 X |
| 4,372,345 | 2/1983 | Mehus | 251/9 X |
| 4,398,577 | 8/1983 | Sauer | 141/135 |
| 4,445,548 | 5/1984 | Neumann | 141/264 X |
| 4,469,148 | 9/1984 | Vögele et al. | 141/87 |
| 4,508,148 | 4/1985 | Trechsel et al. | 141/147 |
| 4,566,505 | 1/1986 | Ruf et al. | 141/83 |
| 4,596,547 | 6/1986 | Troutner | 251/9 X |
| 4,678,015 | 7/1987 | Rague et al. | 141/137 X |

*Primary Examiner*—Ernest G. Cusick
*Attorney, Agent, or Firm*—Vogt & O'Donnell

[57] ABSTRACT

A nozzle for dispensing products, including viscous products, in a container has a longitudinally extending tube mounted to a frame in which the tube is reciprocated vertically in its longitudinal direction. The mounted tube has an inclined wall at its base which forms an end of the tube and extends to a tube bottom inclined wall base edge adjacent an aperture positioned in the longitudinal wall portion. A plate suitable for covering the aperture is stationarily connected to the frame at a position so that upon reciprocation of the tube, the aperture is opened and closed by the plate. When the plate closes the aperture, the plate and tube are pressed to seal the aperture.

8 Claims, 2 Drawing Sheets

NOZZLE FOR DISPENSING PRODUCTS

The present invention relates to a filling nozzle, especially for feeding relatively highly viscous materials into containers.

Normally, during the filling of alu-trays or plastic trays with highly viscous materials, such as mashed potato, it is necessary to position the filling nozzle at a sufficient height above the conveyor that the tray can pass beneath the nozzle which results in an undesirable height of delivery depending on the height of the tray wall. When filling with certain products, the height of the delivery results in an uneven filling and sometimes not at the desired place in the tray.

SUMMARY OF THE INVENTION

The present invention a filling nozzle apparatus having dimensions sufficiently small that enable it to descend into the tray when filling in order to reduce the height of delivery.

Accordingly, the present invention provides a filling nozzle apparatus comprising a tube which is mounted to a stationary frame and which has a portion which extends longitudinally in a vertical orientation to a bottom tube portion which is inclined from the longitudinally extending tube portion and which extends to a base edge so that the base edge of the inclined wall portion is positioned at a bottom extent of the mounted tube to form an end of the tube. The longitudinal tube portion has an aperture positioned adjacent the inclined wall portion base edge. The apparatus includes means for reciprocating the tube in its longitudinal direction. A plate for covering the aperture is stationarily connected to the frame at a position so that upon reciprocation of the tube, the aperture is opened and closed by the plate. The apparatus further includes means to press the tube and plate together when the plate closes the tube for sealing the aperture.

DETAILED DESCRIPTION OF THE INVENTION

The tube of the filling nozzle apparatus of the present invention may be made of stainless steel or plastics material and may have any cross-sectional configuration, for example, circular, oval, or square, but preferably rectangular, and preferably, the cross-sectional shape conforms to the cross-sectional configuration of the container. Preferably, the cross-sectional area of the tube is such that it is capable of passing into the container on descent.

When the tube has a square or rectangular cross-section, conveniently the aperture is positioned at the lower end of one of the four longitudinal walls and preferably extends along the whole width of the wall. The length of the aperture can be chosen to suit requirements and may be, for example, approximately equal to the thickness of the product when filled in the container.

The lower end of the cover plate preferably provides a cutting and sealing function when the tube has ascended to cut off the supply of filling material. For example, the lower end of the cover plate may form a cutting knife which may be made of hard plastics material or stainless steel. If the cutting knife is made of steel, it is desirable to have a sealing means for the aperture when the tube is in its ascended position, e.g., spring-loaded rolls, which press the tube nozzle against the cover plate. The cutting edge of the knife may be straight or, if desired, may be shaped to provide the filled product with a desired pattern.

Means for feeding the filling to the top of the tube is provided, e.g., a flexible hose.

The means enabling the tube to reciprocate vertically may be provided, for instance, by a pneumatic cylinder.

Conveniently, when the tube descends, the lower end passes into the container, preferably almost to the base of the container.

The process employing the apparatus of the present invention may be continuous or discontinuous. In a continuous process, as the leading edge of the container passes beneath the filling nozzle, a sensor causes the tube to descend and then ascend as the rear edge of the container passes beneath the filling nozzle.

Filling materials that are suitable include semi-liquid or solid particles such as powder, granules, flour, etc. When the container is a tray, the diameter of the solid particles should be less then the height of the tray.

The present invention is illustrated by way of Example only with reference to the accompanying drawings.

DETAILED DESCRIPTION OF THE DRAWINGS

Figure 4:
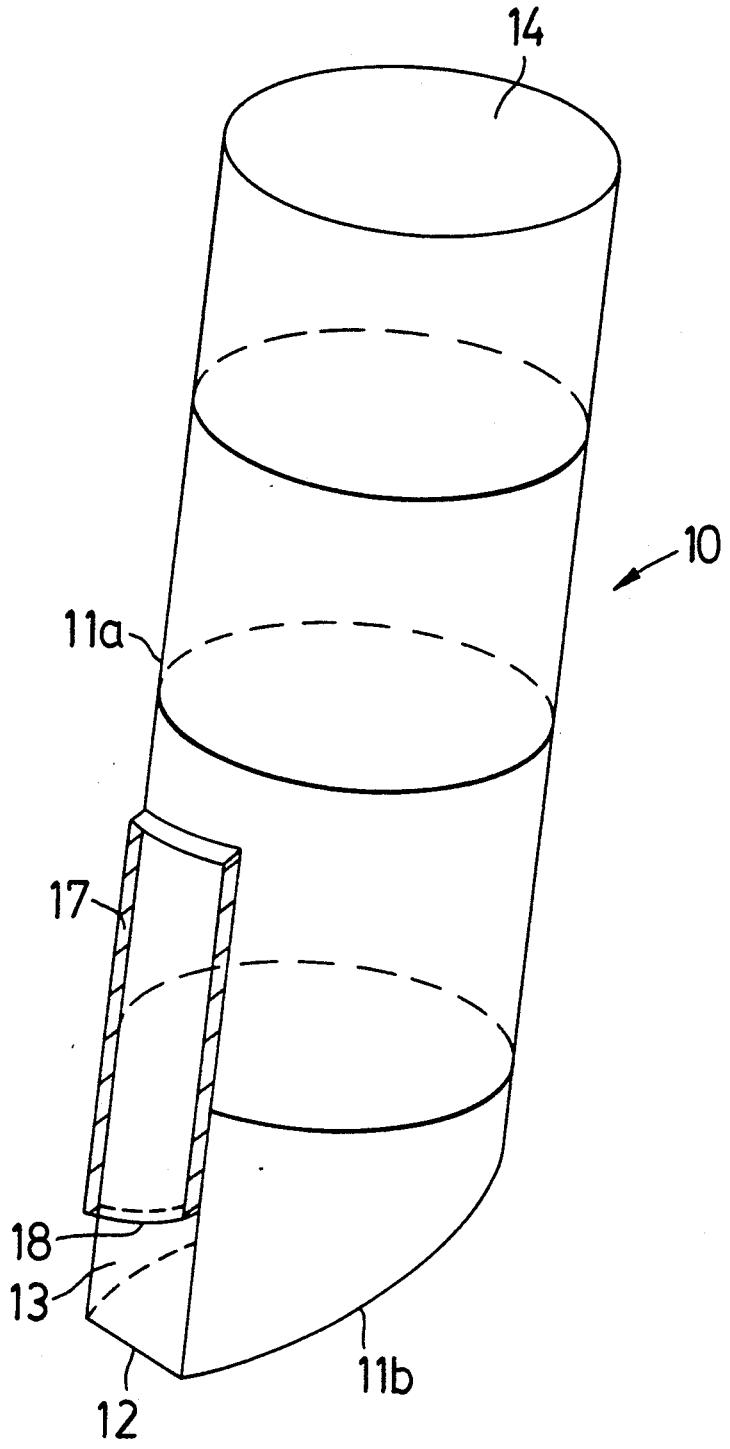
FIG. 4 represents a tube of the filling nozzle having a circular cross-section shape.

Referring to the drawings, a vertically reciprocable tube nozzle 10 of rectangular cross-section (FIG. 1), and circular cross-section (FIG. 4), is provided with longitudinally extending wall portions 11*a* an inclined lower wall base portion 11*b* having a lower edge 12 at the bottom extent of the mounted tube, an aperture 13, which is positioned in a longitudinally extending wall portion adjacent the inclined wall portion base edge 12, and an inlet 14 at the upper end. The tube nozzle 10 is fixed to a pneumatic cylinder 15, which provides means for reciprocating the tube in its longitudinal direction so that the aperture is opened and closed by the plate, and is mounted vertically in a stationary frame 16, the lower part of which is formed into a cover plate 17 whose lower edge forms a cutting knife 18 with a serrated edge. Also depicted are rollers 19 loaded by a spring 20, a conveyor belt 21, a tray 22 and filling material (mashed potatoes) 23. Means for pressing the tube and plate together when the plate closes the tube for sealing the aperture are illustrated by rollers 19 and spring 20.

Figure 1:
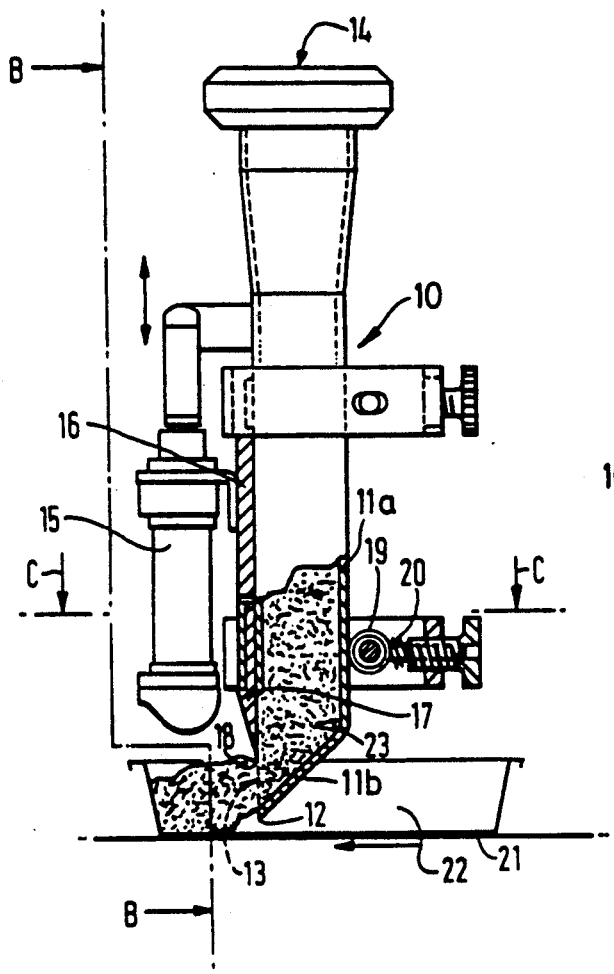
FIG. 1 represents a diagrammatic vertical view, partly in section, of a filling nozzle apparatus of the present invention supplying filling material to an alu-tray.
Figure 2:
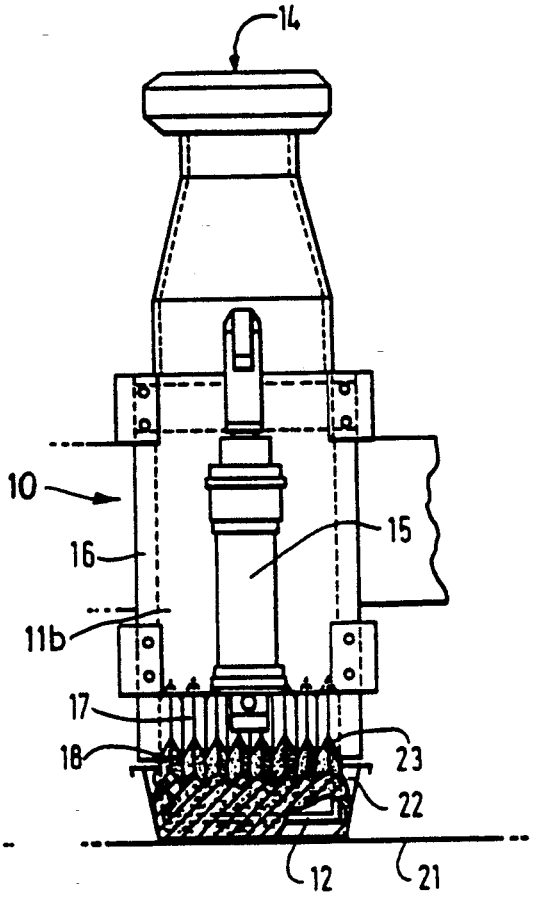
FIG. 2 represents a section along the line B—B of FIG. 1 looking in the direction of the arrows.
Figure 3:
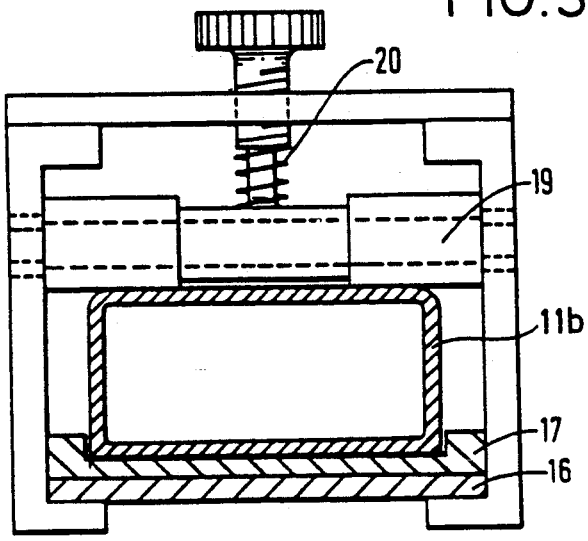
FIG. 3 represents a section along the line C—C of FIG. 1 looking in the direction of the arrows.

In operation, an empty tray 22 is transported in the direction of the arrow in FIG. 1 by the conveyor belt 21 to pass beneath the lower end of the filling nozzle 10 which is in its ascended position, where the cutting knife 18 forms a seal with the lower edge 12 of the lower wall 11. As the leading edge of the tray passes beneath the filling nozzle, a sensor (not shown) actuates the pneumatic cylinder 15 to cause the filling nozzle 10 to descend into the tray 22, whereupon the aperture 13 appears in the gap formed between the descending lower edge 12 of the lower wall 11 and the stationary cutting knife 18 of the cover plate 17. Mashed potatoes flow out through the aperture into the tray as it advances, and because of the serrated edge of the cutting knife 18, the top of the filling has a correspondingly shaped pattern. When the rear end of the tray passes beneath the filling nozzle, the sensor actuates the pneumatic cylinder 15 to ascend and the supply of mashed potatoes is cut off by the ascending lower edge of the lower wall 11 forming a seal with the cutting knife 18.

Sealing of the aperture is helped by the action of the rollers 19 loaded by a spring 20 which press the tube of the filling nozzle against the cover plate 17.

After the tray has been transported away, further trays are conveyed consecutively, and the process repeated.

In claim:

1. A filling nozzle apparatus comprising:

a stationary frame;

a tube which is mounted to the frame, wherein the mounted tube comprises a portion which extends longitudinally in a vertical orientation, a bottom base tube portion, a bottom base edge and an aperture defined by an edge of the longitudinally extending tube portion and the base edge, wherein the base tube portion extends and is inclined from the longitudinally extending tube portion to the base edge so that the base edge is positioned at a bottom extent of the mounted tube;

means for reciprocating the mounted tube in its longitudinal direction;

a plate, for covering the aperture, stationarily connected to the frame at a position so that upon reciprocation of the tube, the aperture is opened and closed by the plate; and means for pressing the tube and plate together when the plate closes the tube for sealing the aperture.

2. An apparatus according to claim 1 wherein the means for pressing comprises rollers positioned adjacent the longitudinally extending tube portion and a spring for pressing the rollers against the tube.

3. An apparatus according to claim 1 wherein the longitudinally extending tube portion is formed by four walls.

4. An apparatus according to claim 3 wherein the aperture is positioned in one wall.

5. An apparatus according to claim 2 wherein the longitudinally extending tube portion is formed by four walls.

6. An apparatus according to claim 5 wherein the aperture is positioned in one wall.

7. An apparatus according to claim 1 wherein the plate has a shaped cutting edge.

8. An apparatus according to claim 1 wherein the tube has a circular cross-section.

* * * * *

UNITED STATES PATENT AND TRADEMARK OFFICE

CERTIFICATE OF CORRECTION

PATENT NO. : 5,246,047

DATED : September 21, 1993

INVENTOR(S) : Hans K. LARSEN

It is certified that error appears in the above-identified patent and that said Letters Patent is hereby corrected as shown below:

Column 3, line 16, "In" should be --I--.

Signed and Sealed this

Twenty-second Day of March, 1994

Bruce Lehman

*Attest:*

BRUCE LEHMAN

*Attesting Officer*

*Commissioner of Patents and Trademarks*